US008111270B2

(12) United States Patent
Kim et al.

(10) Patent No.: US 8,111,270 B2
(45) Date of Patent: Feb. 7, 2012

(54) DRIVING DEVICE INSERTED IMPULSIVE IMAGE, DISPLAY APPARATUS HAVING THE DRIVING DEVICE INSTALLED THEREIN AND METHOD OF DRIVING THE DISPLAY APPARATUS

(75) Inventors: Yun-Jae Kim, Asan-si (KR); Jae-Hyeung Park, Seoul (KR); Min-Kyu Park, Asan-si (KR)

(73) Assignee: Samsung Electronics Co., Ltd. (KR)

( * ) Notice: Subject to any disclaimer, the term of this patent is extended or adjusted under 35 U.S.C. 154(b) by 1050 days.

(21) Appl. No.: 11/972,976

(22) Filed: Jan. 11, 2008

(65) Prior Publication Data

US 2008/0309683 A1 Dec. 18, 2008

(30) Foreign Application Priority Data

Jun. 12, 2007 (KR) ..... 10-2007-0057412

(51) Int. Cl.
*G09G 5/10* (2006.01)

(52) U.S. Cl. ..... 345/690; 345/89

(58) Field of Classification Search ..... 345/84, 345/87, 89, 102, 690, 691, 55, 204; 348/671
See application file for complete search history.

(56) References Cited

U.S. PATENT DOCUMENTS

| | | | | |
|---|---|---|---|---|
| 7,808,461 | B2 * | 10/2010 | Yamazaki et al. | 345/82 |
| 2002/0003522 | A1 * | 1/2002 | Baba et al. | 345/89 |
| 2005/0128167 | A1 * | 6/2005 | Yoon et al. | 345/60 |
| 2006/0146005 | A1 * | 7/2006 | Baba et al. | 345/102 |
| 2006/0152444 | A1 * | 7/2006 | Park | 345/63 |
| 2007/0126757 | A1 * | 6/2007 | Itoh et al. | 345/690 |

FOREIGN PATENT DOCUMENTS

| | | |
|---|---|---|
| JP | 2005164937 | 6/2005 |
| JP | 2006189661 | 7/2006 |
| KR | 1020050055252 | 6/2005 |
| KR | 1020060080887 | 7/2006 |

* cited by examiner

*Primary Examiner* — Chanh Nguyen
*Assistant Examiner* — Pegeman Karimi
(74) *Attorney, Agent, or Firm* — Cantor Colburn LLP

(57) ABSTRACT

A driving device including a signal controller which receives input image data corresponding to a plurality of frame periods, outputs the input image data during a first sub-frame period of one frame period among the plurality of frame periods, and outputs impulsive data having gray-scales, which are lower than those of the input image data, during a second sub-frame period of the one frame period. The impulsive data in the frame periods in which still images are displayed comprise first gray-scales, and the impulsive data in the frame periods in which moving images are displayed comprise second gray-scales, the second gray-scale being different from the first gray-scales. A data driver converts the input image data to pixel voltages during the first sub-frame period, and converts the impulsive data to impulsive voltages during the second sub-frame period.

23 Claims, 12 Drawing Sheets

DRIVING DEVICE INSERTED IMPULSIVE IMAGE, DISPLAY APPARATUS HAVING THE DRIVING DEVICE INSTALLED THEREIN AND METHOD OF DRIVING THE DISPLAY APPARATUS

This application claims priority to Korean Patent application No. 10-2007-0057412, filed on Jun. 12, 2007, and all the benefits accruing therefrom under 35 U.S.C. §119, the contents of which in its entirety are herein incorporated by reference.

BACKGROUND OF THE INVENTION

1. Field of the Invention

The present invention relates to a driving device, a display apparatus having the driving device installed therein and a method of driving the display apparatus. More particularly, the present invention relates to a display apparatus having an improved display quality.

2. Description of the Related Art

Recently, liquid crystal displays have been widely used as flat panel displays. Generally, the liquid crystal displays each include a first substrate on which a first electrode is formed, a second substrate on which a second electrode is formed and a liquid crystal layer formed between the first substrate and the second substrate.

The liquid crystal display applies a voltage to the first electrode and the second electrode to form an electric field in the liquid crystal layer. An intensity of the voltage determines a transmittance of light passing through the liquid crystal layer to display desired images.

When the liquid crystal display displays moving images, transient response characteristics and maintenance characteristics of liquid crystals cause an afterimage and an image blurring effect that may result in insufficient image sharpness.

To prevent the afterimage and the image blurring effect, an impulsive driving method which inserts a black image or a gray image in between displayed images has been suggested. However, since the impulsive driving method inserts the black image or the gray image, each having a lower gray-scale than the displayed images, a brightness of the displayed images may be lowered and a flicker may occur.

BRIEF SUMMARY OF THE INVENTION

Embodiments of the present invention provide a driving device capable of reducing or effectively preventing a blurring of moving image, a deterioration of image brightness, and an occurrence of flicker. Embodiments of the present invention also provide a display apparatus having the above driving device installed therein. The present invention also provides a method of driving the display apparatus.

In one embodiment of the present invention, a driving device is provided and includes a signal controller which receives input image data corresponding to a plurality of frame periods outputs the input image data during a first sub-frame period of one frame period among the plurality of frame periods, and outputs impulsive data having gray-scales, which are lower than those of the input image data, during a second sub-frame period of the one frame period. The impulsive data in the frame periods in which still images are displayed comprise first gray-scales, and comprise second gray-scales, the second gray-scale being different from the first gray-scales. A data driver converts the input image data to pixel voltages during the first sub-frame period, and converts the impulsive data to impulsive voltages during the second sub-frame period.

In another embodiment of the present invention, a display apparatus includes a signal controller, a data driver, and a display panel.

The signal controller receives input image data corresponding to a plurality of frame periods, outputs the input image data during a first sub-frame period of one frame period among the plurality of frame periods, and outputs impulsive data having gray-scales lower which are than those of the input image data during a second sub-frame period of the one frame period. The impulsive data in the frame periods in which still images are displayed comprise different gray-scales from the impulsive data in the frame periods in which moving images are displayed.

The data driver converts the input image data from the signal controller to pixel voltages and converts the impulsive data from the signal controller to impulsive voltages.

The display panel displays normal images during the first sub-frame period in response to the pixel voltages, and displays impulsive images during the second sub-frame period in response to the impulsive voltages. The impulsive images displayed in the frame periods in which the still images are displayed comprise different gray-scales from the impulsive images displayed in the frame periods in which the moving images are displayed.

In another embodiment of the present invention, a method of driving a display apparatus comprises receiving a plurality of input image data respectively corresponding to a plurality of frame periods, detecting movement information of the input image data, determining whether the input image data are still or moving images based on the detected movement information, outputting the input image data during a first sub-frame of one frame period, converting the input image data to corresponding pixel voltages, displaying normal images corresponding to the pixel voltages, outputting impulsive data comprising gray-scales which are lower than those of the input image data during a second sub-frame period of the one frame period, the impulsive data in the frame periods in which the still images are displayed comprising gray-scales which are different from gray-scales of the impulsive data in the frame periods in which the moving images are displayed, converting the impulsive data to corresponding impulsive voltages, and displaying impulsive images corresponding to the impulsive voltages, the impulsive images in the frame periods in which the still images are displayed comprising different levels of brightness from the impulsive images in the frame periods in which the moving images are displayed.

In another embodiment of the invention, a driving device comprises a signal controller which receives and outputs input image data during a first sub-frame period of one frame period, and which outputs impulsive data having gray-scales, which are lower than those of the input image data, during a second sub-frame period of the one frame period. The impulsive data in the frame periods in which still images are displayed comprise first gray-scales, and the impulsive data in the frame periods in which moving images are displayed comprise second gray-scales, the second gray-scale being different from the first gray-scales. A data driver converts the input image data to pixel voltages during the first sub-frame period, and converts the impulsive data to impulsive voltages during the second sub-frame period.

Accordingly, impulsive images that gradually increase from the second target gray-scale to the first target gray-scale and which are maintained in the first target gray-scale are inserted in between the normal images during the frame periods in which the still images are displayed. Also, the impulsive images that gradually decrease from the first target gray-scale to the second target gray-scale and which are maintained in the second target gray-scale are inserted in between the normal images during the frame periods in which the moving images are displayed.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
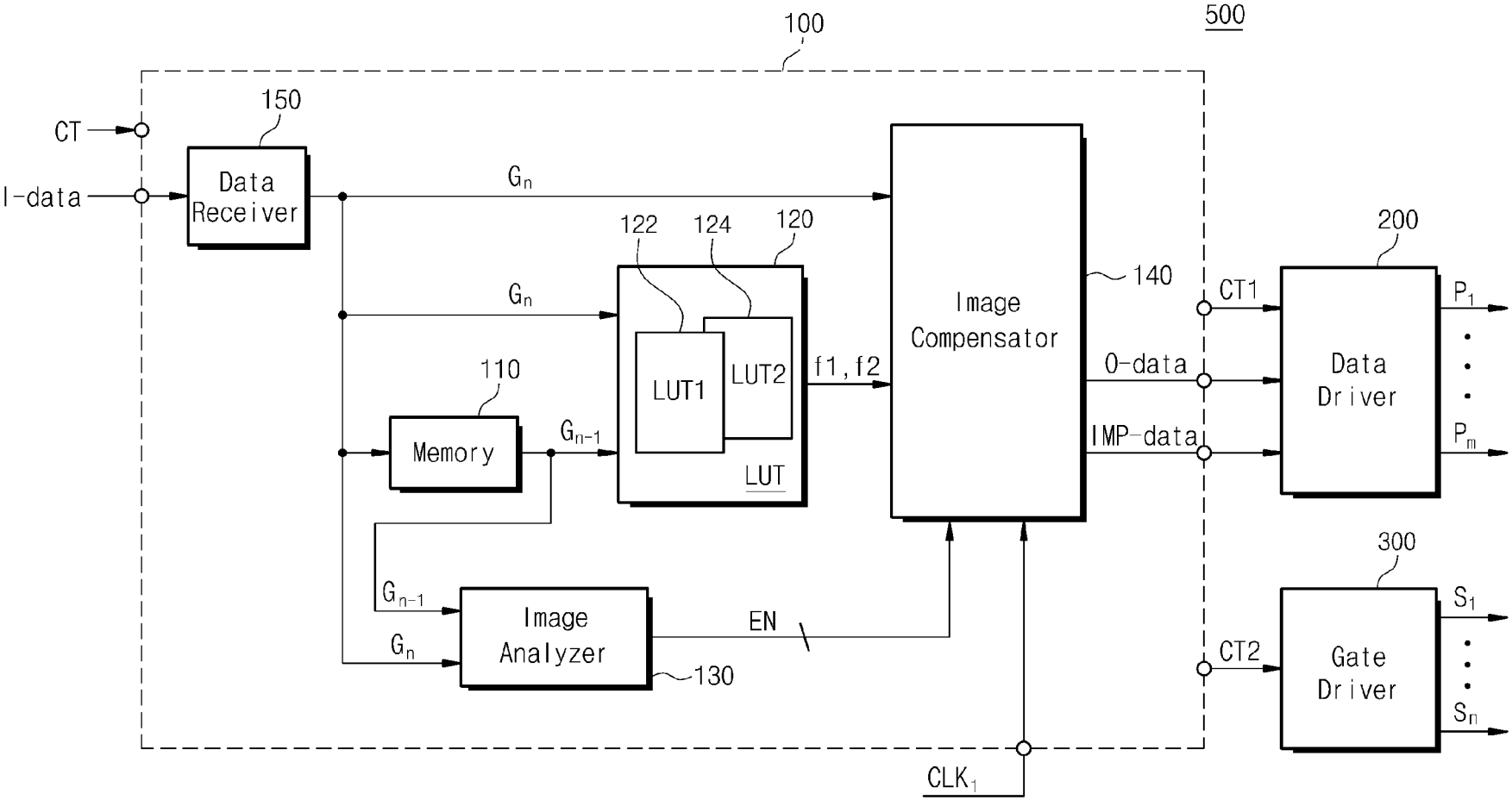
FIG. 1 is a block diagram showing an exemplary embodiment of a driving device according to the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be explained in further detail with reference to the accompanying drawings.

FIG. 1 is a block diagram showing an exemplary embodiment of a driving device according to the present invention. As shown in FIG. 1, a driving device 500 for use with a display apparatus is provided. The driving device 500 divides one frame into a first sub-frame period and a second sub-frame period. During the first sub-frame period, the driving device 500 outputs input image data I-data corresponding to a normal image. Similarly, during the second sub-frame period, the driving device 500 outputs impulsive data IMP-data corresponding to an impulsive image. When the impulsive data IMP-data is inserted in between frames as a black image, a malfunction, such as blurring, that occurs when displaying the moving image may be reduced or effectively prevented.

As shown in FIG. 1, the driving device 500 includes a signal controller 100. The signal controller 100 outputs the impulsive data IMP-data that each include different gray-scale levels from one another in accordance with the input image data I-data. In particular, the signal controller 100 outputs the impulsive data IMP-data having a first target gray-scale GRAY-min during the frame periods in which still images are displayed. Similarly, the signal controller outputs the impulsive data IMP-data having a second target gray-scale GRAY-max, which may be lower than the first target gray-scale GRAY-min, during the frame periods in which moving images are displayed. Thus, the impulsive image having a first brightness corresponding to the first target gray-scale GRAY-min may be inserted in between the still images, and the impulsive image having a second brightness, which may be darker than the first brightness, may be inserted in between the moving images.

The first target gray-scale GRAY-min may be obtained by dividing a value that may be obtained by an addition of a gray-scale of present image data Gn to a gray-scale of previous image data Gn−1 by a division factor of 2. The first target grey-scale may be represented as the following.

$$\text{GRAY-min} = \frac{g_{n-1} + g_n}{2} \qquad \text{Equation 1}$$

In equation 1, $g_{n-1}$ represents the gray-scale of the previous image data Gn−1 and $g_n$ represents the gray-scale of the present image data Gn.

The second target gray-scale GRAY-max may be obtained by a division of a value that may be obtained by an addition of the gray-scale of the present image data Gn to the gray-scale of the previous image data Gn−1 by a division factor of 4. The second target grey-scale may be represented as the following.

$$\text{GRAY-max} = \frac{g_{n-1} + g_n}{4} \qquad \text{Equation 2}$$

The signal controller 100 of the driving device 500 outputs the impulsive data, IMP-data, which gradually increase from the second target gray-scale GRAY-max to the first target gray-scale GRAY-min during a portion of the frame periods during which the still images are displayed. Further, the signal controller 100 outputs the impulsive data IMP-data that are maintained at the second target gray-scale GRAY-max during a remaining portion of the frame periods during which the still images are displayed.

Conversely, the signal controller 100 outputs the impulsive data IMP-data, which gradually decrease from the first target gray-scale GRAY-min to the second target gray-scale GRAY-max, during a portion of the frame periods during which the moving images are displayed. Further, the signal controller 100 outputs the impulsive data IMP-data that are maintained at the first target gray-scale GRAY-min during a remaining portion of the frame periods during which the moving images are displayed.

The impulsive data IMP-data, which gradually increase or decrease between the first and second target gray-scales GRAY-min and GRAY-max, are calculated based on gray-scale values that are obtained by various division factors from 2 to 4, e.g., 2, 2.01, 2.02, . . . , 3.99, 4.

However, it may be noted that the division calculation using division factors non-integers may be difficult to realize even when using hardware. Furthermore, if a lookup table corresponding to all possible division factors were able to be prepared conveniently, the impulsive data IMP-data may be calculated using data obtained from the lookup table. However, preparing such a lookup table corresponding to all possible division factors may be inefficient in view of the size and the cost of the necessary amount of memory such an endeavor would require.

Accordingly, the signal controller 100 includes only first and second lookup tables 122 and 124 corresponding to the division factors 2 and 4, respectively. As such, the signal controller 100 calculates the impulsive data IMP-data corresponding to a division factor lying between the division factor of 2 and the division factor of 4 using a linear interpolation method.

Still referring to FIG. 1, the driving device 500 includes the signal controller 100, as noted above, and further includes a data driver 200 and a gate driver 300. Here, the signal controller 100 sequentially receives the input image data I-data corresponding to the frame periods. The signal controller 100 outputs a data control signal CT1 and a gate control signal CT2 based on various control signals CT input from an external device.

The signal controller 100 includes a memory 110, a lookup table 120, an image analyzer 130, and an image compensator 140. The signal controller 100 may further include a data receiver 150 although embodiments exist in which the data receiver 150 may be unnecessary. Where the signal controller 100 includes the data receiver 150, the data receiver 150 receives input image data I-data from an external device (e.g. a graphic controller) and changes the input image data I-data into image data to be processed within the signal controller 100. The memory 110 includes a frame memory, in which the image data may be stored by one-frame increments. Here, it may be understood that the image data could also be stored in increments of 2 or more frames. In particular, when the signal controller 100 receives the input image data Gn of the present frame (hereinafter, referred to as "present image data"), the input image data Gn−1 of a previous frame (hereinafter, referred to as "previous image data") may be read out from the memory 110. Then, when next image data Gn+1 is input to the memory 110, the present image data Gn may be output from the memory 110.

The lookup table 120 includes a first lookup table ("LUT1") 122 and a second lookup table ("LUT2") 124. The first lookup table 122 receives the previous image data Gn−1 and the present image data Gn and subsequently outputs first interpolation data f1 that corresponds to a combination of the previous image data Gn−1 and the present image data Gn. In addition, the second lookup table 124 receives the previous image data Gn−1 and the present image data Gn and subsequently outputs second interpolation data f2 that corresponds to another combination of the previous image data Gn−1 and the present image data Gn.

Figure 2:
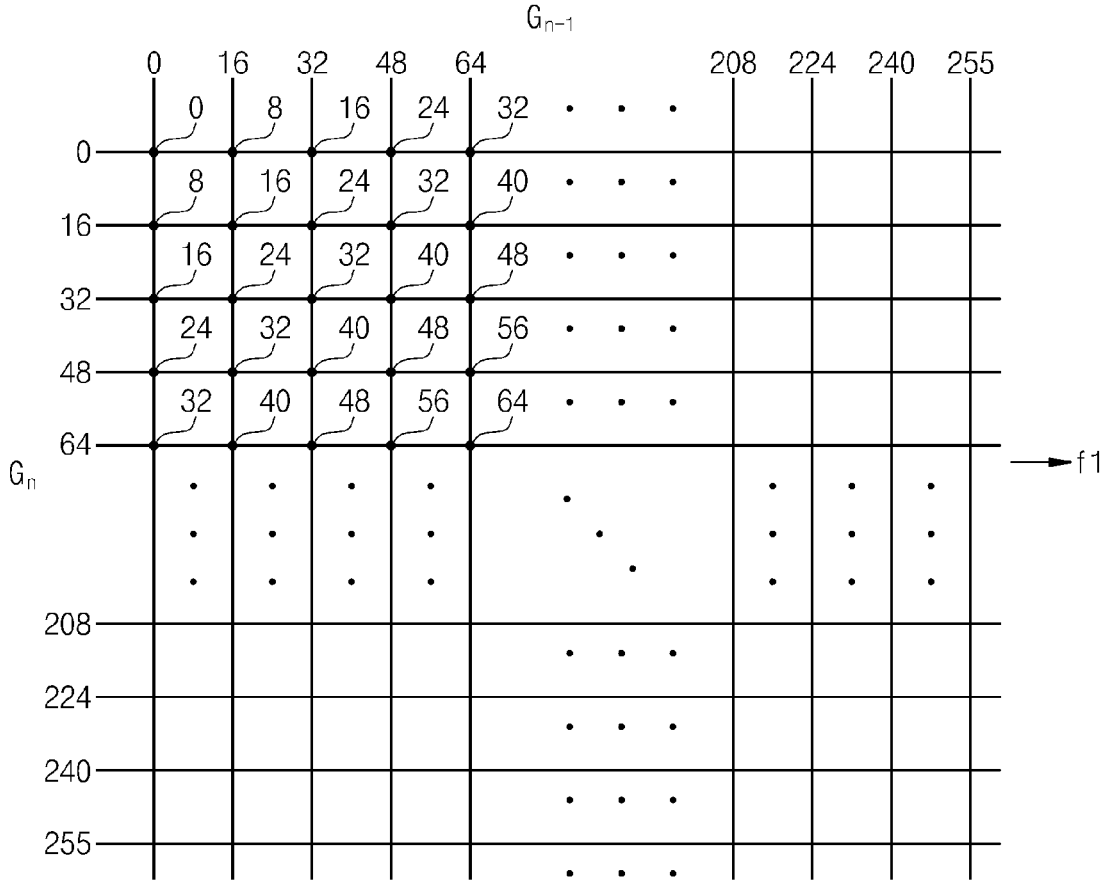
FIGS. 2 and 3 are schematic diagrams illustrating a first exemplary lookup table and a second exemplary lookup table, respectively, of the driving device according to the present invention shown in FIG. 1.
Figure 3:
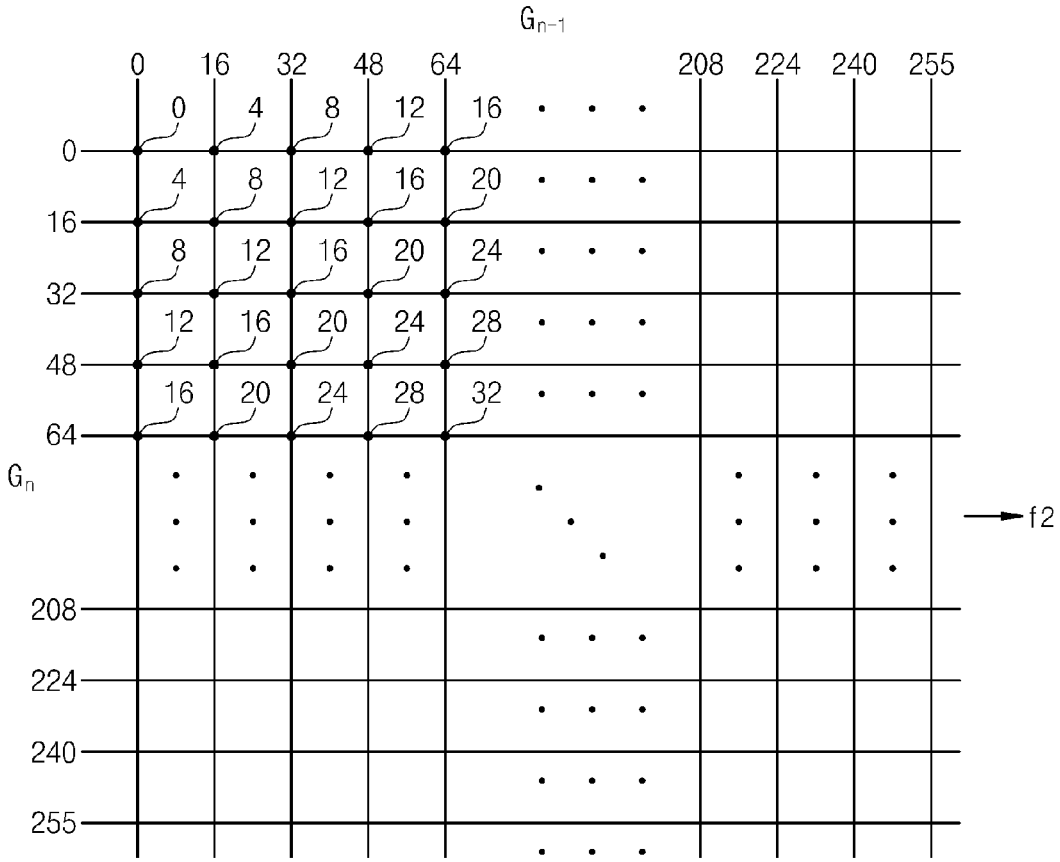

FIGS. 2 and 3 are schematic illustrations of exemplary first and second lookup tables of FIG. 1. Referring to FIG. 2, items of gray-scale information calculated by equation 1 are stored in the first lookup table 122. That is, the first lookup table 122 stores the first interpolation data f1, which may be obtained by dividing the value obtained by adding the previous image data Gn−1 to the present image data Gn by the division factor of 2, therein. As shown in FIG. 2, the first interpolation data f1 stored in the first lookup table 122 corresponds to only the combination of $(2^{\alpha}+1)\times(2^{\alpha}+1)$. This combination is, therefore, determined by a number of upper significant bits ($\alpha$) of the present image data Gn and a number of lower significant bits ($\alpha$) of the previous image data Gn−1.

In the present exemplary embodiment, the lookup table 120 has been shown in a situation in which a number of the significant bits of the present image data Gn and the previous image data Gn−1 may be 4. Thus, the first lookup table 122 comprises a 17 block×17 block matrix. The first interpolation data f1 that do not exist in the first lookup table 122 and which correspond to the combination of the previous image data Gn−1 and the present image data Gn may be calculated by a method of bi-linear interpolation.

Referring to FIG. 3, the second lookup table 124 stores the second interpolation data f2, which may be obtained by dividing the value obtained by adding the previous image data Gn−1 to the present image data Gn by the division factor of 4, therein. As in the first lookup table 122, the second lookup table 124 comprises a 17 block×17 block matrix. As is described above, the second interpolation data f2 that do not exist in the second lookup table 124 and which correspond to the combination of the previous image data Gn−1 and the present image data Gn may be calculated by a method of bi-linear interpolation.

The impulsive data IMP-data that gradually increase or decrease between the first target gray-scale GRAY-min and the second target gray-scale GRAY-max are calculated with the use of the first and second interpolation data f1 and f2. This will be described later with reference to FIGS. 8 and 9.

The image analyzer 130 receives the present image data Gn from the data receiver 150 and the previous image data Gn−1 from the memory 110. The image analyzer 130 then compares the present image data Gn and the previous image data Gn−1 and subsequently outputs an enable signal EN. The enable signal EN serves to determine whether the present image is a still image or a moving image, as will be discussed below.

Figure 4:
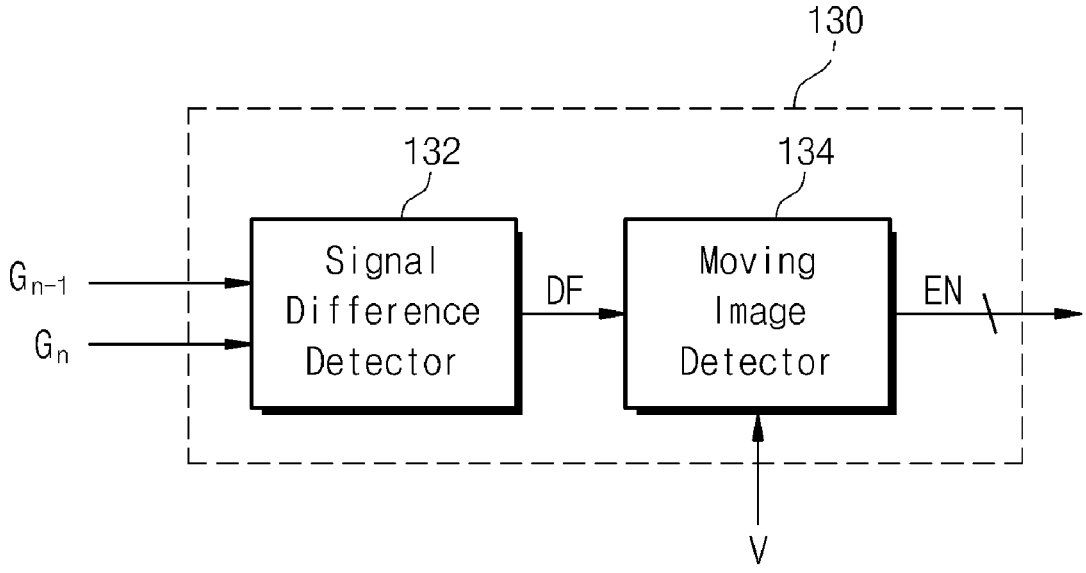
FIG. 4 is a block diagram of an exemplary image analyzer of the driving device according to the present invention in FIG. 1.

FIG. 4 is a block diagram showing an image analyzer 130 of the exemplary embodiment of FIG. 1. Referring to FIG. 4, the image analyzer 130 includes a signal difference detector 132 and a moving image detector 134. The signal difference detector 132 compares the present image data Gn with the previous image data Gn−1 stored in the memory 320. The signal difference detector 132 further detects a signal difference value DF between the present image data Gn and the previous image data Gn−1 so as to output the signal difference value DF. The moving image detector 134 receives the signal difference value DF from the signal difference detector 132 and compares the signal difference value DF with a reference value V. In various embodiments of the invention, the reference value V may be inputted from an external device or may be stored in a local memory. The moving image detector 134 then outputs the enable signal EN in a form that represents whether the present image data Gn includes the still images or the moving images. That is, in an exemplary embodiment, when the signal difference value DF is smaller than the reference value V, the present image data Gn may be determined to include still images and the moving image detector 134 outputs the enable signal EN at logic level low 'L.' On the contrary, when the signal difference value DF is greater than the reference value V, the present image data Gn may be determined to include moving images and the moving image detector 134 outputs the enable signal EN at logic level high 'H.' That is, according to the design of the image analyzer 130, the moving image detector 134 outputs the enable signal EN at the logic level high 'H' and the logic level low 'L' in accordance with a presence of the still images and the moving images, respectively. Thus, the enable signal EN may be maintained in the logic level high 'H' during the frame periods in which the present image data Gn includes the moving images, and may be maintained in the logic level low 'L' during the frame periods in which the present image data Gn includes the still images. However, it may be understood that other embodiments are possible. For example, the enable signal EN could be maintained in the logical level 'L' during the frame periods where the present image data Gn includes the moving images. Similarly, the enable signal EN could be maintained in the logic level 'H' during the frame periods where the present image data Gn includes the still images.

In further embodiments of the invention, the moving image detector 134 outputs the enable signal EN by a single frame unit or in increments of 2 or more frame units. That is, while the present exemplary embodiment has been described in which the enable signal EN includes one-bit data that may be represented by the logic level low 'L' and the logic level high 'H,' the enable signal EN may also be represented as a data bit that may be equal to or greater than two bits.

The image compensator 140 receives the present image data Gn through the data receiver 150. The image compensator 140 subsequently outputs the normal image data O-data, having a same or similar gray-scale as the present image data Gn, during the first sub-frame period of one frame period, and outputs the impulsive data IMP-data, having a lower gray-scale than the input image data I-data, during the second sub-frame period of the one frame period.

Figure 5:
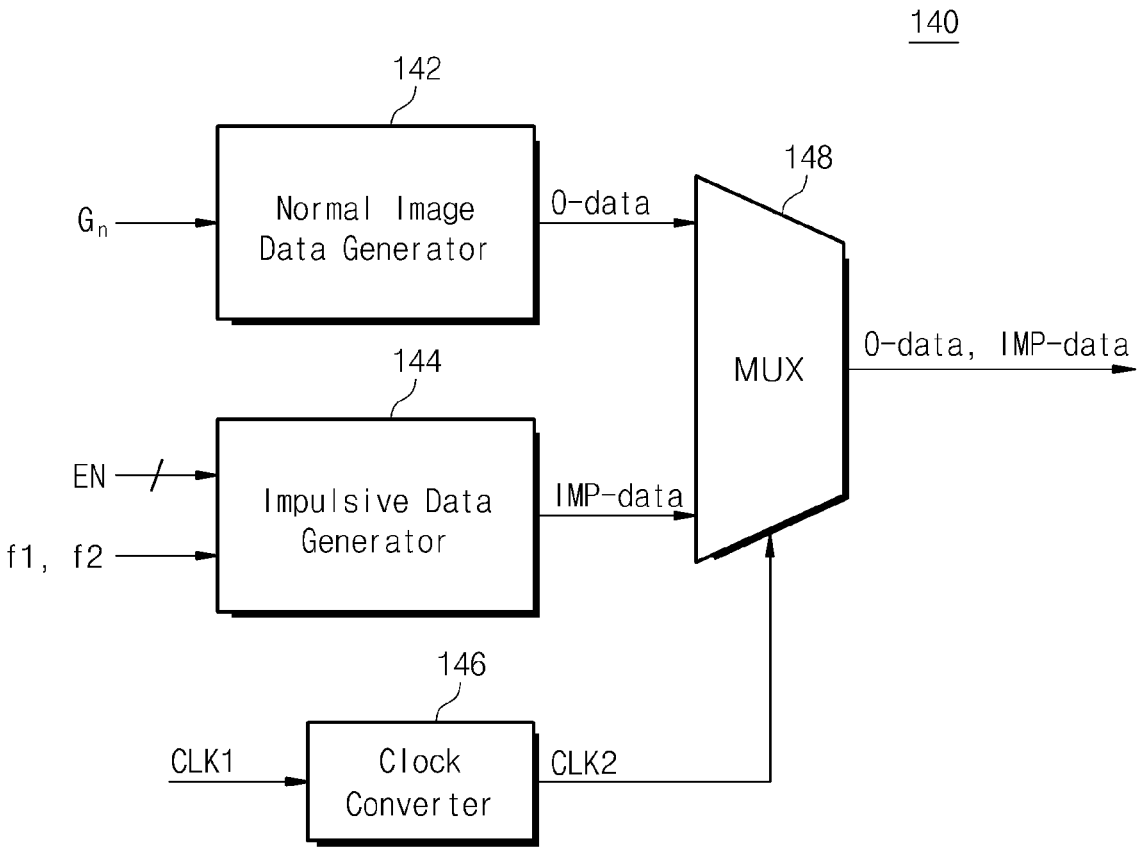
FIG. 5 is a block diagram of an exemplary image compensator of the driving device according to the present invention in FIG. 1.

FIG. 5 is a block diagram showing an exemplary image compensator 140 of the exemplary embodiment of FIG. 1. Referring to FIG. 5, the image compensator 140 includes a normal image data generator 142, an impulsive data generator 144, a clock converter 145, and a multiplexer ("MUX") 138. The normal image data generator 142 receives the present image data Gn and subsequently outputs the normal image data O-data during the first sub-frame period. The impulsive data generator 144 receives both the first interpolation data f1 and the second interpolation data f2 from the lookup table 120. The impulsive data generator 144 linearly interpolates the first and second interpolation data f1 and f2 in response to the enable signal EN from the image analyzer 130 and calculates a final item of interpolation data. Using the calculated final interpolation data, the impulsive data generator 144 may be then able to output the impulsive data IMP-data in correspondence with the calculated final interpolation data. The impulsive data IMP-data, which corresponds to the final interpolation data, includes impulsive data that gradually increase to the first target gray-scale GRAY-min as well as impulsive data that gradually decrease to the second target gray-scale GRAY-max.

Figure 6:
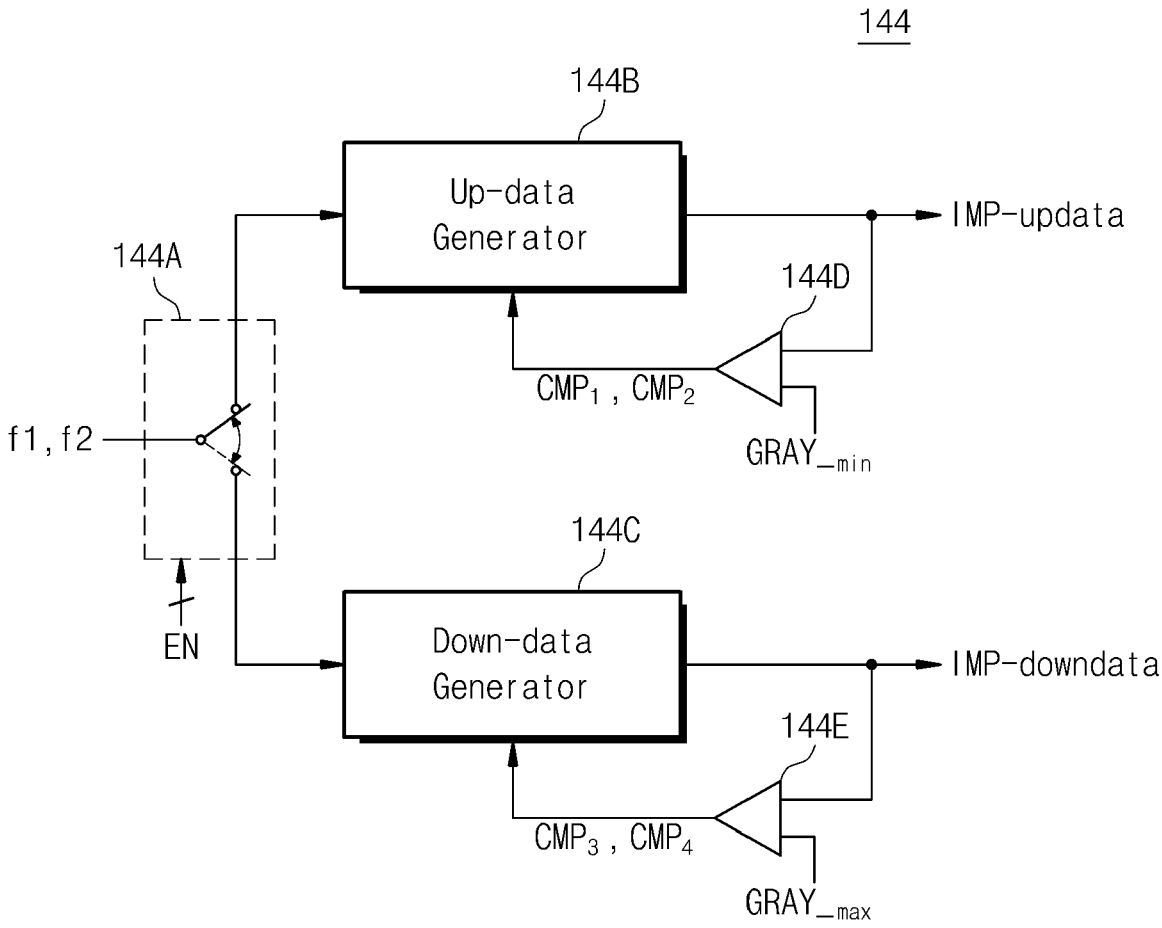
FIG. 6 is a block diagram of an exemplary impulsive data generator of the driving device according to the present invention in FIG. 5.

FIG. 6 is a block diagram showing an exemplary impulsive data generator 144 of the exemplary embodiment of FIG. 5. Referring to FIG. 6, the impulsive data generator 144 includes a switching device 144A, an up-data generator 144B, a down-data generator 144C, a first comparator 144D, and a second comparator 144E. The switching device 144A receives the first and second interpolation data f1 and f2 from the lookup table 120 and selectively provides the first and second interpolation data f1 and f2 to the up-data generator 144B and the down-data generator 144C in response to the enable signal EN, as will be discussed below.

That is, in an embodiment of the invention, when the enable signal EN, having the logic level low 'L' may be input, the switching device 144A provides the first and second interpolation data f1 and f2 to the up-data generator 144B. Similarly, when the enable signal EN, having the logic level high 'H' may be input, the switching device 144A provides the first and second interpolation data f1 and f2 to the down-data generator 144C. Of course, it may be again noted that this is only an exemplary embodiment of the impulsive data generator and that embodiments could exist in which the operations of the switching device 144A, the up-data generator 144B and the down-data generator 144C could be reversed or otherwise altered. In similar fashion, it will be further understood that the operations of the first comparator 144D and the second comparator E could also be reversed or otherwise altered.

According to the present exemplary embodiment, the up-data generator 144B outputs the impulsive data IMP-updata that gradually increase to the first target gray-scale GRAY-min in response to a reception of a first comparison signal CMP1, and also outputs the impulsive data IMP-updata that are maintained in the first target gray-scale GRAY-min in response to a reception of a second comparison signal CMP2. The up-data generator 144B interpolates and calculates the first and second interpolation data f1 and f2, and also outputs the impulsive data IMP-updata that gradually increase during the first frame period.

The first comparator 144D compares the gray-scale of the impulsive data IMP-updata, output from the up-data generator 144B, with the first target gray-scale GRAY-min, and subsequently outputs the first comparison signal CMP1 or the second comparison signal CMP2 based on a result of the comparison. That is, the first comparator 144D outputs the first comparison signal CMP1 when the gray-scale of the impulsive data IMP-updata from the up-data generator 144B may be smaller than the first target gray-scale GRAY-min, and outputs the second comparison signal CMP2 when the gray-scale of the impulsive data IMP-updata from the up-data generator 144B may be greater than the first target gray-scale GRAY-min.

The down-data generator 144C outputs the impulsive data IMP-downdata that gradually decrease to the second target gray-scale GRAY-max in response to a third comparison signal CMP3, and subsequently outputs the impulsive data IMP-downdata that may be maintained in the second target gray-scale GRAY-max in response to a fourth comparison signal CMP4. The down-data generator 144C outputs the impulsive data that gradually decrease based on the first and second interpolation data f1 and f2 from the lookup table 120.

The second comparator 144E compares the gray-scale of the impulsive data IMP-downdata, which may be output from the down-data generator 144C, with the second target gray-scale GRAY-max, and subsequently outputs the third comparison signal CMP3 or the fourth comparison signal CMP4 based on a result of the comparison. That is, the second comparator 144E outputs the third comparison signal CMP3 when the gray-scale of the impulsive data IMP-downdata from the down-data generator 144C may be greater than the second target gray-scale GRAY-max, and outputs the fourth comparison signal CMP4 when the gray-scale of the impulsive data IMP-downdata from the down-data generator 144C may be equal to or smaller than the second target gray-scale GRAY-max.

With reference still to FIG. 5, the clock converter 146 receives a first synchronizing signal CLK1 from an external device and subsequently outputs a second synchronizing signal CLK2 having a frequency that is twice that of the first synchronizing signal CLK1. That is, in an exemplary embodiment of the invention, when the first synchronizing signal CLK1, having a frequency of about 60 Hz, is input to the clock converter 146, the clock converter 146 converts the first synchronizing signal CLK1 to the second synchronizing signal CLK2 having a frequency of about 120 Hz. The second synchronizing signal CLK2, which may be output from the clock converter 146, is applied to the multiplexer 148.

The multiplexer 148 selectively outputs the normal image data O-data from the normal image data generator 142 and the impulsive data IMP-data from the impulsive data 144 by a frame unit whenever the second synchronizing signal CLK2 is input. Here, it may be understood that, in other embodiments of the invention, the multiplexer 148 could output the normal image data O-data and the impulsive data IMP-data in frame units of 2 or more frames.

With reference back to FIG. 1, the driving device 500 further includes the data driver 200 and the gate driver 300, as shown. Referring to FIG. 1, the data driver 200 converts the present image data Gn to present pixel voltages P1~Pm and outputs the present pixel voltages P1~Pm in response to the first control signal CT1 during the first sub-frame period. The data driver 200 also converts the impulsive data IMP-data to impulsive voltages and outputs the impulsive voltages during the second sub-frame period. The data driver 200, therefore, outputs the impulsive voltages having voltage levels that are different from each other in accordance with the presence and characteristics of the still images and the moving images.

In particular, the data driver 200 outputs the impulsive voltages, which gradually increase from a first voltage level to a second voltage level during the first frame periods of the frame periods in which the still images are displayed, and outputs the impulsive voltages maintained in the second voltage level during the second frame periods of the frame periods in which the still images are displayed. In this case, the first and second voltage levels substantially correspond to the first and second target gray-scales GRAY-min and GRAY-max, respectively.

On the contrary, the data driver 200 outputs the impulsive voltages, which gradually decrease from the second voltage level to the first voltage level during the third frame periods of the frame periods in which the moving images are displayed, and subsequently outputs the impulsive voltages that are maintained in the first voltage level during the fourth frame periods of the frame periods in which the moving images are displayed.

The gate driver 300 outputs a first gate pulse during the first sub-frame period in response to the second control signal CT2. In addition, the gate driver 300 sequentially outputs first to n-th scan signals S1~Sn so as to output a second gate pulse during the second sub-frame period.

Figure 7:
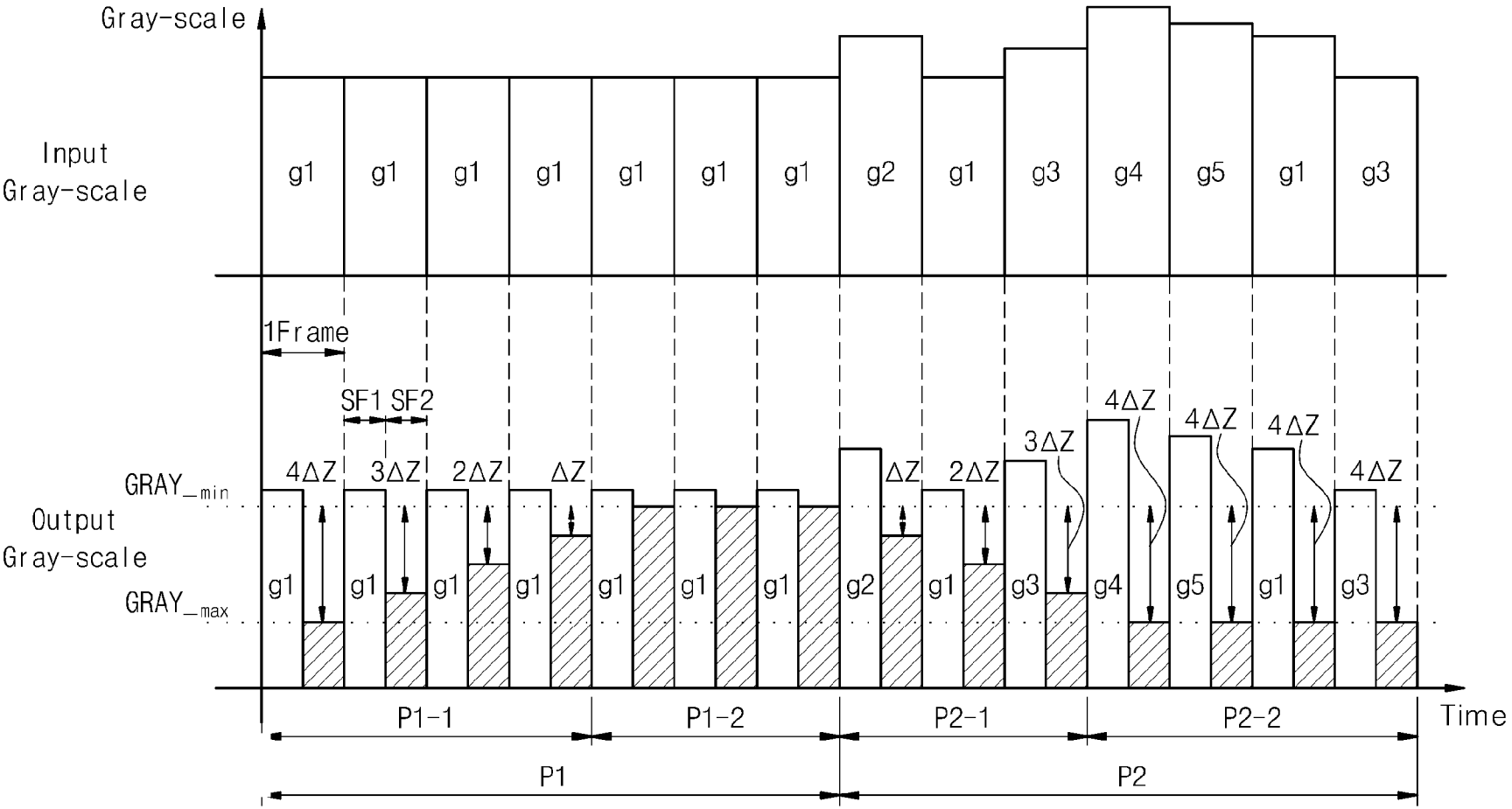
FIG. 7 is a graph of exemplary gray-scale levels versus time showing gray-scale variations of impulsive data output from a signal controller of present invention in FIG. 1.

FIG. 7 is a graph showing gray-scale variations of the impulsive data output from a signal controller of FIG. 1. Referring to FIG. 7, an upper portion of the graph represents gray-scale variations of the input image data, and a lower portion of the graph represents gray-scale variations of the impulsive data that correspond to the input image data. Further, in the frame periods P1 and P2, the input image data have the same or similar gray-scale g1 when the still images are displayed. Conversely, the input image data may have the gray-scale g1 as well as the gray-scales g2, g3, g3 or g5 when the moving images are displayed.

During the first frame periods P1-1 of the frame period P1 in which the still images are displayed, the signal controller 100 outputs the impulsive data IMP-data, which gradually increase to the first target gray-scale GRAY-min. Then, during the second frame periods P1-2 of the frame periods P1, the signal controller 100 outputs the impulsive data IMP-data, which may be maintained in the first target gray-scale GRAY-min.

During the third frame periods P2-1 of the frame period P2 in which the moving images are displayed, the signal controller 100 outputs the impulsive data IMP-data, which gradually decrease to the second target gray-scale GRAY-max. Then, during the fourth frame periods P2-2 of the frame periods P2, the signal controller 100 outputs the impulsive data IMP-data, which may be maintained in the first target gray-scale GRAY-min.

As shown in FIG. 7, the increasing values +ΔZ of the gray-scale of the impulsive data IMP-data during the first frame periods P1-1 and the decreasing values −ΔZ of the gray-scale of the impulsive data IMP-data during the third frame periods P2-1 are the same or substantially similar values. However, the increasing values +ΔZ and the decreasing values −ΔZ are not necessary the same. In other words, when the decreasing values −ΔZ of the gray-scale of the impulsive data for the moving images are greater than those of the impulsive data for the still images, the malfunction, such as blurring, that occurs at the beginning of the frame periods where the moving images are displayed, may be reduced or effectively prevented.

Hereinafter, the calculation of the impulsive data that are gradually varied will be described using a linear-interpolation calculation, with reference to at least FIG. 8, which is a schematic view explaining a conventional linear-interpolation calculation.

Figure 8:
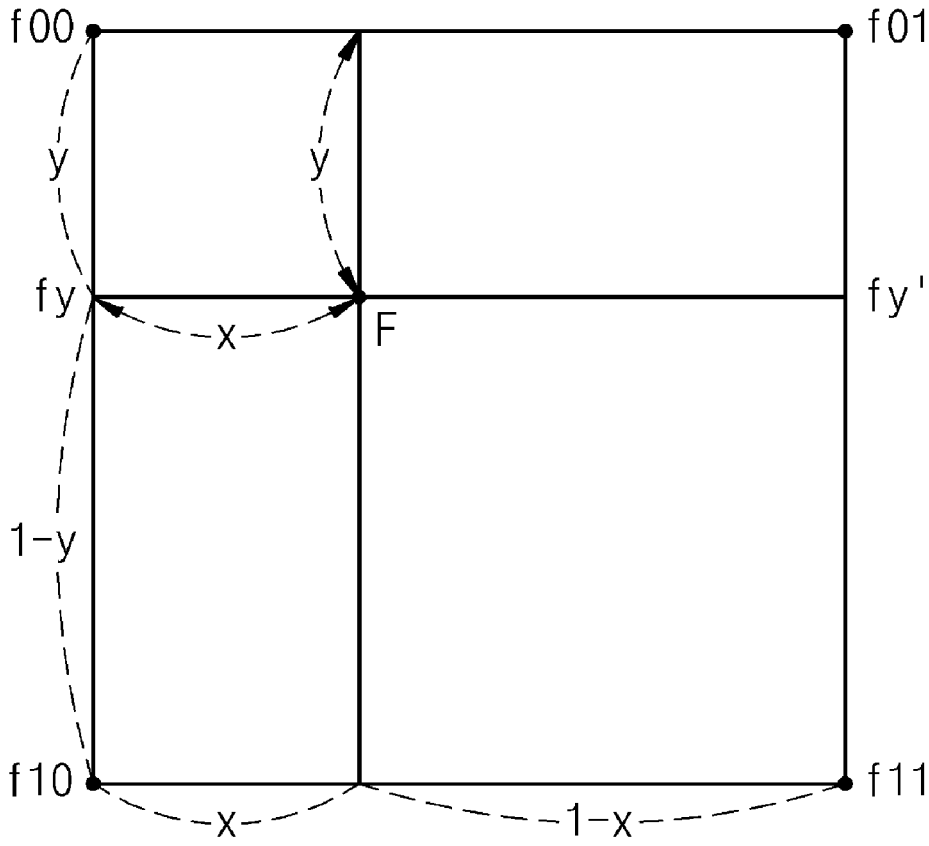
Fig. 8 (Related Art)
FIG. 8 is a schematic view illustrating a linear-interpolation calculation of the prior art.

With reference to FIG. 8, a bi-linear interpolation calculation is an algorithm that is obtained by an expansion of the linear-interpolation calculation between two items of position data to the linear-interpolation calculation with respect to four items of position data.

First, second, third, fourth items of interpolation reference position data f00, f10, f01 and f11 define a shape of a lattice. A target interpolation value F may be then calculated based on positions and attitudes of the first to fourth items of interpolation reference position data f00, f10, f01, and f11. That is, a first column substance value fy of the target interpolation value F may be calculated by the following equation 3, a second column substance value fy' of the target interpolation value F may be calculated by the following equation 4.

$$fy=f_{00}+y(f_{10}-f_{00}) \quad \text{Equation 3}$$

In equation 3, fy, f00, y, and f10 represent a first column substance value, the first item of interpolation reference position data in a first column direction, an interval between column gray-scale levels, and the second item of interpolation reference position data in the first column direction, respectively.

$$fy'=f_{01}+y(f_{11}-f_{01}) \quad \text{Equation 4}$$

In equation 4, fy', y, f01, and f11 represent a second column substance value, the interval between the column gray-scale levels, the third item of interpolation reference position data in the first column direction, and the fourth item of interpolation reference position data in the first column direction, respectively.

Thus, the target interpolation value F may be calculated by a following equation 5 based on the first column substance value fy and the second column substance value fy'.

$$\begin{aligned} F &= fy - x(fy - fy') \quad \text{Equation 5} \\ &= f_{00} + (f_{01} - f_{00})x + (f_{10} - f_{00})y + (f_{00} + f_{11} - f_{01} - f_{10})xy \\ &= f_{00} + ax + by + cxy \end{aligned}$$

In equation 5, "a", "b", and "c" represent values of f01−f00, f10−f00, and f00+f11−f10, respectively.

Figure 9:
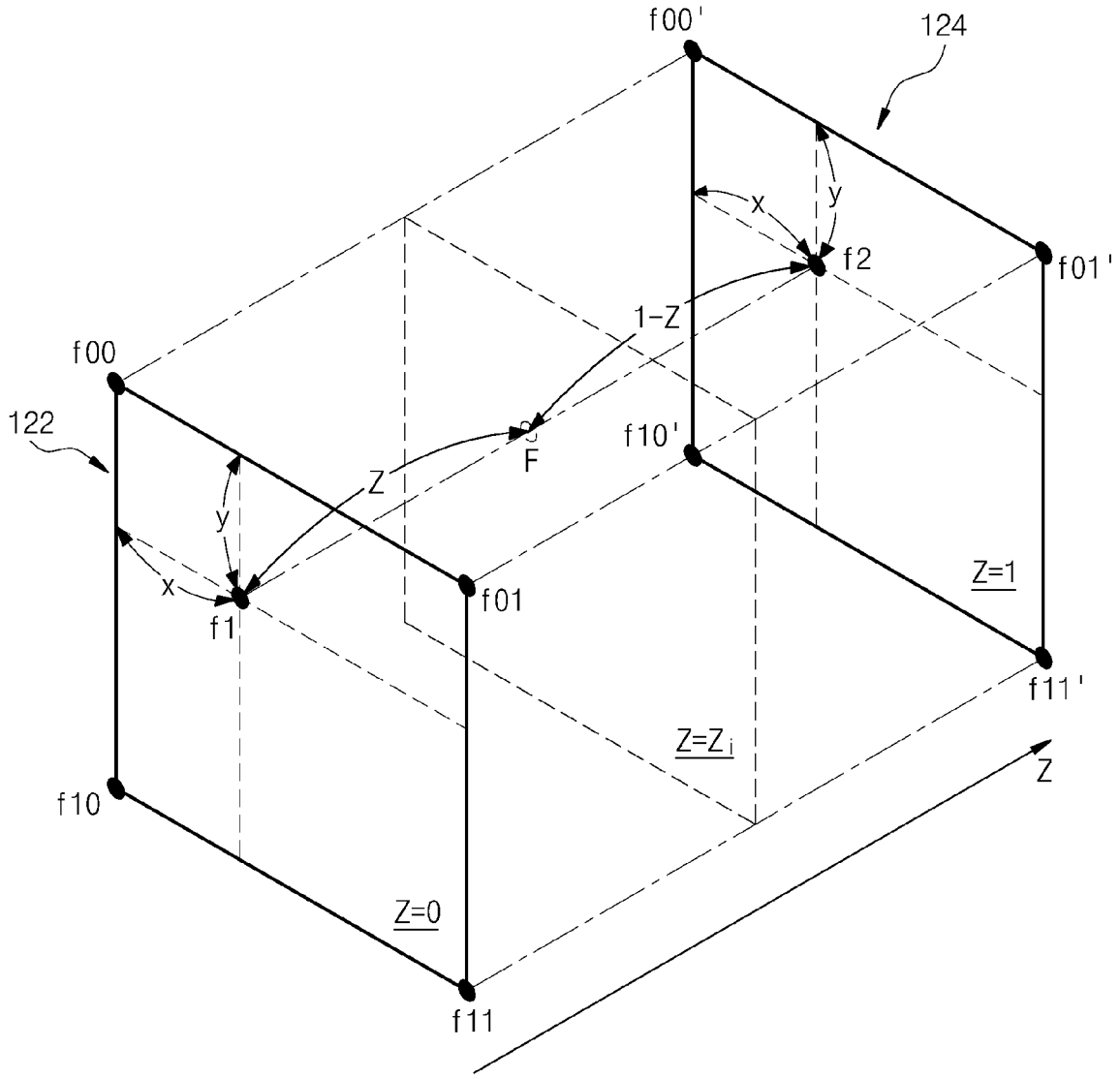
FIG. 9 is a schematic view illustrating an exemplary linear-interpolation calculation according to the present invention.

FIG. 9 is a schematic view explaining a linear-interpolation calculation according to an exemplary embodiment of the present invention. As shown in FIG. 9, parameter Z represents the gray-scales of the impulsive data that gradually increase or decrease between the first and second target gray-scales GRAY-min and GRAY-max. Also, it is noted that the parameter Z increases at regular intervals or irregular intervals between 0 and 1.

A method of calculating a gray-scale Zi of certain impulsive data between the first and second target gray-scales GRAY-min and GRAY-max may be as follows. In the following description, it may be assumed that the previous image data Gn−1 and the present image data Gn corresponding to the gray-scale Zi of the certain impulsive data do not exist in the first and second lookup tables 122 and 124, respectively.

The first interpolation data f1, obtained from the first lookup table 122, may be calculated through the following equation 6 using the bi-interpolation calculation.

$$f1=f_{00}+ax+by+cxy \quad \text{Equation 6}$$

In equation 6, "a", "b", and "c" represent f01−f00, f10−f00, and f00+f11−f10, respectively.

The second interpolation data f2, obtained from the second lookup table 124, through the following equation 7 using the bi-interpolation calculation.

$$f1=f_{00}'+a'x+b'y+c'xy \quad \text{Equation 7}$$

In equation 7, a', b', and c' represent f01'−f00', f10'−f00', and f00'+f11'−f01'−f10', respectively.

The impulsive data generator 144 calculates the final interpolation data F using the first interpolation data f1 and the second interpolation data f2, and subsequently outputs the impulsive data IMP-data using the calculated final interpolation data F.

The final interpolation data F may be then calculated by the following equation 8 using the linear interpolation calculation.

$$F=(1-Z)F1+ZF2 \quad \text{Equation 8}$$

Thus, the final interpolation data F may be (1−Zi)F1+ZiF2 with respect to the gray-scale Zi.

Figure 10:
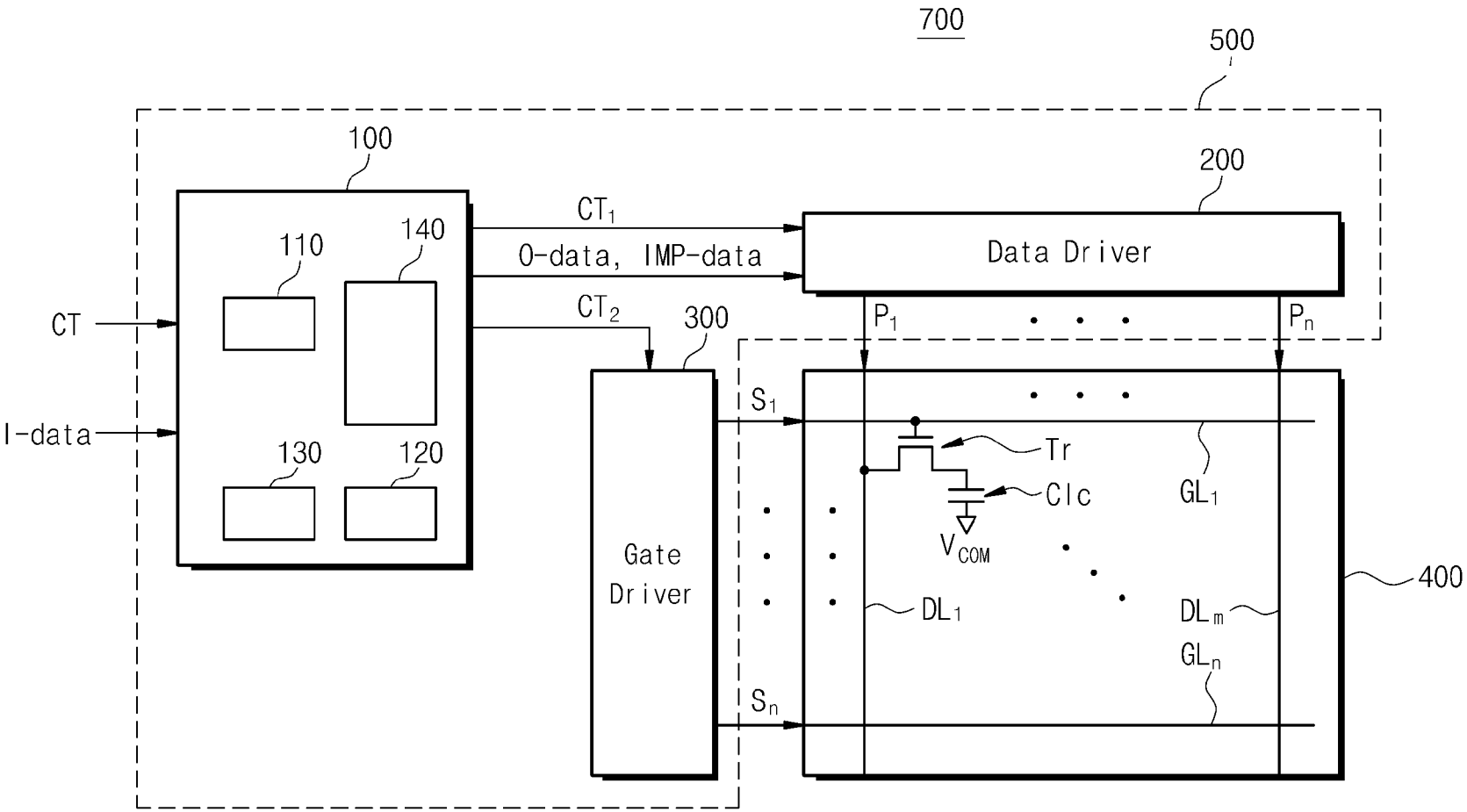
FIG. 10 is a block diagram of an exemplary embodiment of a display apparatus employing the driving device according to the present invention in FIG. 1.

FIG. 10 is a block diagram showing an exemplary embodiment of a display apparatus employing the driving device of FIG. 1. In FIG. 10, the same reference numerals denote the same elements in FIG. 1. Thus, the detailed descriptions of the same elements will be omitted.

As shown in FIG. 10, a display apparatus 700 includes the signal controller 100, the data driver 200, the gate driver 300, and a display panel 400. The signal controller 100 receives the control signal CT from an external device and the input image data I-data. In the present exemplary embodiment, the control signal CT includes various signals, such as a vertical synchronization signal, a horizontal synchronization signal, a main clock, a data enable signal, other signals and/or combinations thereof. The signal controller 100 then generates the data control signal CT1 and the gate control signal CT2 in accordance with the control signal CT.

The data control signal CT1 may be applied to the data driver 200 to control an operation of the data driver 200. The data control signal CT1 includes a horizontal start signal that starts the operation of the data driver 200, an inversion signal that inverts a polarity of the data voltage, and an output indication signal that indicates the output timing of the data voltage.

The gate control signal CT2 may be applied to the gate driver 300 to control an operation of the gate driver 300. The gate control signal CT2 includes a vertical start signal that starts the operation of the gate driver 300, a gate clock signal that decides the output timing of the gate pulse, and an output enable signal that decides a pulse width of the gate pulse.

The display panel 400 includes first to m-th data lines DL1~DLm and first to n-th gate lines GL1~GLn. The first to m-th data lines DL1~DLm are coupled, such as by an electric connection, to the data driver 200 and receive the first to m-th pixel voltages P1~Pm from the data driver 200, respectively. The first to n-th gate lines GL1~GLn are coupled, such as by an electric connection, to the gate driver 300 and receive the first to n-th scan signals S1~Sn that are sequentially output from the gate driver 300. The first to m-th data lines DL1~DLm are insulated from while traversing the first to n-th gate lines GL1~GLn to define the pixel areas, which are expressed as intersections of the lines DL1~DLm and the gate lines GL1~GLn on the display panel 400 in a matrix-like configuration.

In each of the pixel areas, a thin film transistor Tr and a liquid crystal capacitor Clc are formed. For instance, the thin film transistor Tr, formed in a first pixel area, includes a gate electrode, which may be coupled to the first gate line GL1, a source electrode, which may be coupled to the first data line DL1, and a drain electrode, which may be coupled to a first terminal of the liquid crystal capacitor Clc. The liquid crystal capacitor Clc includes a second terminal to which a common voltage Vcom may be applied.

When the first scan signal S1 is applied to the first gate line GL1, the first pixel voltage P1 may be applied to the first terminal of the liquid crystal capacitor Clc through the thin film transistor Tr. Thus, the liquid crystal capacitor Clc may be charged with a voltage that corresponds to a voltage difference between the first pixel voltage P1 and the common voltage Vcom.

As shown in FIG. 10, when assuming that the common voltage Vcom may be 0V, the liquid crystal capacitor Clc may be charged with the first pixel voltage P1 during the first sub-frame of the one frame. Then, the impulsive voltage may be applied to the first terminal of the liquid crystal capacitor Clc during the second sub-frame of the one frame.

The display panel 400 sequentially displays images that correspond to the impulsive voltages that gradually increase from the first target gray-scale to the second target gray-scale and which are maintained in the second target gray-scale during the first sub-frames of the frame periods where the still images are displayed.

In addition, the display panel 400 sequentially displays images that correspond to the impulsive voltages that gradually decrease from the second target gray-scale to the first target gray-scale and which are maintained in the first target gray-scale during the first sub-frames of the frame periods where the moving images are displayed.

Figure 11:
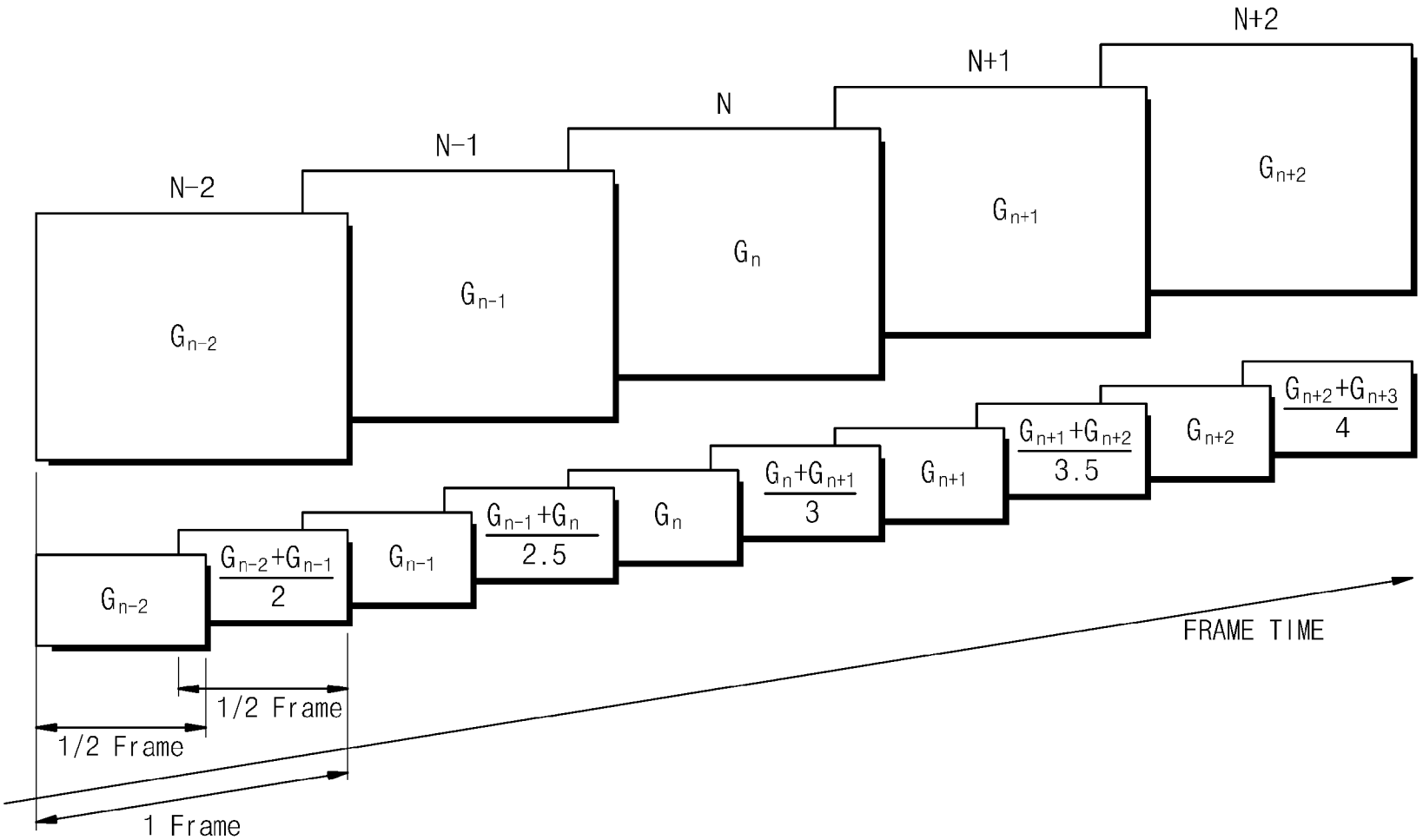
FIG. 11 is a graph of exemplary successive frames versus time showing impulsive images displayed on a display panel of the display apparatus according to the present invention in FIG. 10.

FIG. 11 shows impulsive images displayed on a display panel of the exemplary embodiment of FIG. 10 during the frames for moving images. As shown in FIG. 11, five image fields arranged at an upper portion represent input image fields applied to the display apparatus 700 from an external device, and ten image fields arranged at a lower portion represent output image fields displayed through the display apparatus 700.

During (N−1)-th frame period of the frame periods where the moving images are displayed, the impulsive image that corresponds to the impulsive data obtained by the division factor of 2.5 may be inserted. During N-th frame period, the impulsive image that corresponds to the impulsive data obtained by the division factor of 3 may be inserted. Then, during (N+1)-th frame period, the impulsive image corresponding to the impulsive data obtained by the division factor of 3.5 may be inserted.

Thus, the gray-scale (or the brightness) of the impulsive image gradually decreases during the (N−1)-th frame period and the (N+1)-th frame period. From the (N+2)-th frame period, the impulsive image that may be obtained by the division factor of 4 and which may be maintained in the second target gray-scale GRAY-max may be continuously inserted by the frame unit.

In FIG. 10, the signal controller 100 in which various elements, such as the memory 110, the lookup table 120, the image analyzer 130, and the image compensator 140, are installed has been shown. However, it may be understood that in various embodiments of the invention, the memory 110, the lookup table 120, the image analyzer 130, and the image compensator 140 may be jointly or separately separated from the signal controller 100.

Figure 12:
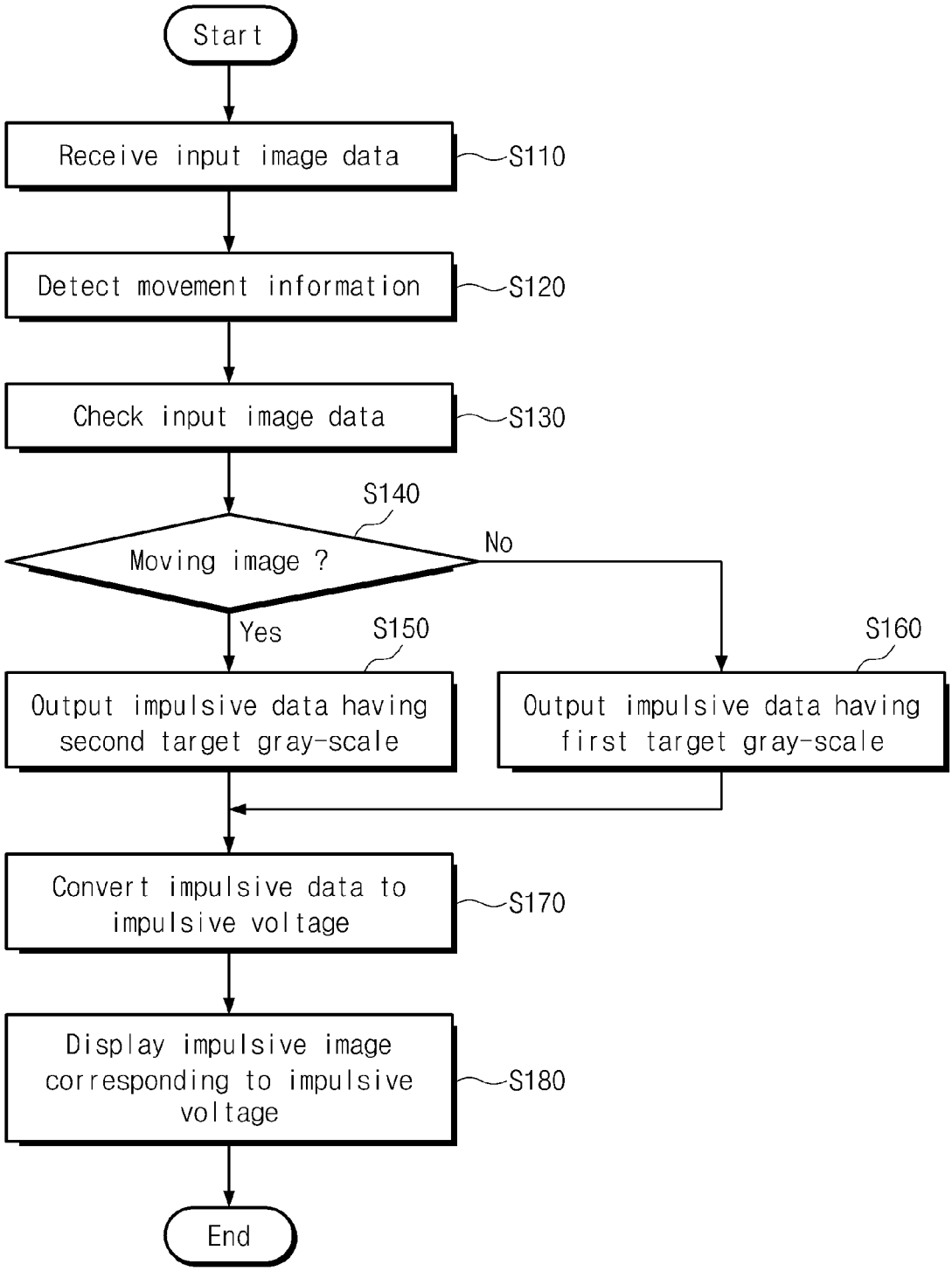
FIG. 12 is a flowchart illustrating an exemplary method of driving the display apparatus according to the present invention in FIG. 10.

FIG. 12 is a flowchart explaining a method of driving the display apparatus of FIG. 10. With reference to FIG. 12, the display apparatus 700 receives the input image data corresponding to the frame periods (S110). The display apparatus 700 detects movement information from the input image data (S120), and checks whether the input image data are the moving images based on the detected movement information (S130).

When the input image data are found to include moving images (S140), the normal image data O-data, having the same or similar gray-scale as the input image data, are output during the first sub-frame periods, and the impulsive data IMP-data, having the second target gray-scale GRAY-max, are output during the second sub-frame periods (S150). Here, the impulsive data IMP-data gradually decrease from the first target gray-scale GRAY-min to the second target gray-scale GRAY-max during the frame periods in which the moving images are displayed, and are maintained in the second target gray-scale GRAY-max.

When the input image data are found to include the still images (S140), the normal image data O-data, having the same gray-scale as the input image data, are output during the first sub-frame periods, and the impulsive data IMP-data, having the first target gray-scale GRAY-min which are higher than the second target gray-scale GRAY-max, are output during the second sub-frame periods (S160). Here, the impulsive data IMP-data gradually increase from the second target gray-scale GRAY-max to the first target gray-scale GRAY-min, and are maintained in the first target gray-scale GRAY-min.

Then, the normal image data O-data are converted to the pixel voltages, and the impulsive data IMP-data are changed to the impulsive voltages (S170). The display apparatus 700 subsequently sequentially displays the images corresponding to the pixel voltages and the images corresponding to the impulsive voltages during one frame period (S180), or, in other embodiment of the invention, multiple frame periods. Here, the brightness of the images that corresponds to the impulsive voltages gradually increases from a first brightness to a second brightness higher than the first brightness, and may be maintained at the second brightness. In the present exemplary embodiment, the first brightness and the second brightness respectively correspond to the first and second target gray-scales GRAY-min and GRAY-max.

During the frame periods in which the moving images are displayed, the brightness of the images corresponding to the impulsive voltages gradually decreases from the second brightness to the first brightness and then maintains the first brightness. Accordingly, the impulsive images have different gray-scales from each other in accordance with the inserted input images. That is, the impulsive images that gradually increase from the second target gray-scale to the first target gray-scale and which are maintained in the first target gray-scale are inserted in between the normal images during the frame periods where the still images are displayed. Also, the impulsive images that gradually decrease from the first target gray-scale to the second target gray-scale and which are maintained in the second target gray-scale are inserted in between the normal images during the frame periods where the moving images are displayed. Thus, a problem of the blurring of the moving images may be improved so that a lowering of the brightness and a flicker may each be reduced or effectively prevented.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A driving device, comprising:

a signal controller which:

receives input image data corresponding to a plurality of frame periods, outputs the input image data during a first sub-frame period of one frame period among the plurality of frame periods, and outputs impulsive data having gray-scales, which are lower than those of the input image data, during a second sub-frame period of the one frame period, wherein:

the impulsive data in the frame periods in which still images are displayed comprise first gray-scales, and the impulsive data in the frame periods in which moving images are displayed comprise second gray-scales, the second gray-scale being different from the first gray-scales; and a data driver which:

converts the input image data to pixel voltages during the first sub-frame period, and converts the impulsive data to impulsive voltages during the second sub-frame period.

2. The driving device according to claim 1, wherein the signal controller is configured:

to output the impulsive data, the impulsive data having a first target gray-scale in the frame periods in which the still images are displayed, and to output the impulsive data, the impulsive data having a second target gray-scale that is lower than the first target gray-scale in the frame periods in which the moving images are displayed.

3. The driving device according to claim 2, wherein the impulsive data having the first target gray-scale comprise:

first impulsive data that gradually increase from the second target gray-scale to the first target gray-scale during first frame periods of the frame periods in which the still images are displayed; and second impulsive data that are maintained in the first target gray-scale during second frame periods of the frame periods in which the still images are displayed.

4. The driving device according to claim 3, wherein the impulsive data having the second target gray-scale comprise:

third impulsive data that gradually decrease from the first target gray-scale to the second target gray-scale during third frame periods of the frame periods in which the moving images are displayed and which are temporally adjacent to the second frame periods; and fourth impulsive data that are maintained in the second target gray-scale during fourth frame periods of the frame periods in which the moving images are displayed.

5. The driving device according to claim 4, wherein:

the first target gray-scale is in accordance with a value of an addition of a gray-scale of the input image data of a previous frame to a gray-scale of the input image data of a present frame, the value being divided by a first division factor, and the second target gray-scale is in accordance with a value of the added value divided by a second division factor, which is greater than the first division factor.

6. The driving device according to claim 5, wherein the first division factor is 2, and the second division factor is 4.

7. The driving device according to claim 4, wherein an increased rate of the impulsive data that gradually increase from the second target gray-scale to the first target gray-scale is substantially equal to a decreased rate of the impulsive data that gradually decrease from the first target gray-scale to the second target gray-scale.

8. The driving device according to claim 4, wherein an increased rate of the impulsive data that gradually increase from the second target gray-scale to the first target gray-scale is different from a decreased rate of the impulsive data that gradually decrease from the first target gray-scale to the second target gray-scale.

9. The driving device according to claim 4, wherein an increased value of the impulsive data that gradually increase from the second target gray-scale to the first target gray-scale and a decreased value of the impulsive data that gradually decrease from the first target gray-scale to the second target gray-scale are substantially uniform with respect to one another.

10. The driving device according to claim 4, wherein the signal controller comprises:

a memory which:

stores the input image data by a frame unit, outputs previous image data, which is previously stored therein during a previous frame period, in a present frame period, and writes present image data that is input during the present frame period;

a lookup table which stores first and second stored interpolation and which outputs first and second interpolation data corresponding to the previous image data and the present image data, respectively;

an image analyzer which compares the previous image data and the present image data and which outputs an enable signal to indicate whether the present image data are the moving images; and an image compensator which:

receives the first and second interpolation data, responsive to the enable signal, outputs the first and second impulsive data during the frame periods where the still images are displayed, and outputs the third and fourth impulsive data during the frame periods where the moving images are displayed.

11. The driving device according to claim 10, wherein the lookup table comprises:

a first lookup table which stores the first interpolation data that correspond to the first target gray-scale; and a second lookup table which stores the second interpolation data that correspond to the second target gray-scale.

12. The driving device according to claim 11, wherein:

the image compensator:

calculates the first interpolation data through a bi-linear interpolation calculation and outputs the second impulsive data corresponding to the first target gray-scale based on the calculated first interpolation data when the first interpolation data does not exist in the first lookup table, and the image compensator calculates the second interpolation data through the bi-linear interpolation calculation and outputs the fourth impulsive data corresponding to the second target gray-scale when the second interpolation data does not exist in the second lookup table.

13. The driving device according to claim 12, wherein the image compensator interpolates the first and second interpolation data through a linear interpolation calculation and outputs the first and third impulsive data corresponding to a grey-scale between the first and second target gray-scales.

14. A display apparatus, comprising:

a signal controller which:

receives a plurality of items of input image data corresponding to a plurality of frame periods, outputs the input image data during a first sub-frame period of one frame period among the frame periods, outputs impulsive data comprising:

gray-scales lower than those of the input image data during a second sub-frame period of the one frame period, the impulsive data in the frame periods in which still images are displayed having different gray-scales from those of the impulsive data in the frame periods where moving images are displayed;

a data driver which converts the input image data to pixel voltages and which converts the impulsive data to impulsive voltages; and a display panel which:

displays normal images during the first sub-frame period in response to the pixel voltages, and displays impulsive images during the second sub-frame period in response to the impulsive voltages, the impulsive images being displayed in the frame periods in which the still images are displayed as having different gray-scales from those of the impulsive images displayed in the frame periods in which the moving images are displayed.

15. The display apparatus according to claim 14, wherein the signal controller outputs:

the impulsive data having a first target gray-scale in the frame periods in which the still images are displayed, and the impulsive data having a second target gray-scale lower than the first target gray-scale in the frame periods in which the moving images are displayed.

16. The display apparatus according to claim 15, wherein:

the impulsive data, having the first target gray-scale, gradually increase from the second target gray-scale to the first target gray-scale and are maintained in the first target gray-scale during the frame periods in which the still images are displayed, and the impulsive data, having the second target gray-scale, gradually decrease from the first target gray-scale to the second target gray-scale and are maintained in the second target gray-scale during the frame periods in which the moving images are displayed.

17. The display apparatus according to claim 14, wherein the display panel:

displays the impulsive images as having a first brightness during the frame periods in which the still images are displayed, and displays the impulsive images as having a second brightness lower than the first brightness during the frame periods in which the moving images are displayed.

18. The display apparatus according to claim 17, wherein:

the impulsive images, having the first brightness, gradually increase from the second brightness to the first brightness and are maintained in the first brightness during the frame periods in which the still images are displayed, and the impulsive images, having the second brightness, gradually decrease from the first brightness to the second brightness and are maintained in the second brightness during the frame periods in which the moving images are displayed.

19. A method of driving a display apparatus, the method comprising:

receiving a plurality of input image data respectively corresponding to a plurality of frame periods;

detecting movement information of the input image data;

determining whether the input image data are still or moving images based on the detected movement information;

outputting the input image data during a first sub-frame of one frame period;

converting the input image data to corresponding pixel voltages;

displaying normal images corresponding to the pixel voltages;

outputting impulsive data comprising gray-scales which are lower than those of the input image data during a second sub-frame period of the one frame period, the impulsive data in the frame periods in which the still images are displayed comprising gray-scales which are different from gray-scales of the impulsive data in the frame periods in which the moving images are displayed;

converting the impulsive data to corresponding impulsive voltages; and displaying impulsive images corresponding to the impulsive voltages, the impulsive images in the frame periods in which the still images are displayed comprising different levels of brightness from the impulsive images in the frame periods in which the moving images are displayed.

20. The method according to claim 18, wherein:

the gray-scales of the impulsive data gradually increase from a second target gray-scale to a first target gray-scale during the frame periods in which the still images are displayed, and the gray-scales of the impulsive data gradually decrease from the first target gray-scale to the second target gray-scale during the frame periods in which the moving images are displayed.

21. The method according to claim 20, wherein:

the first target gray-scale is calculated by dividing a value obtained by adding the gray-scale of the input image data applied in a previous frame to the gray-scale of the input image data applied in a present frame by 2, and the second target gray-scale is calculated by dividing the value obtained by adding the gray-scale of the input image data applied in the previous frame to the gray-scale of the input image data applied in the present frame by 4.

22. The method according to claim 21, wherein the gray-scales of the impulsive data are calculated from the first and second target gray-scales through a linear interpolation calculation.

23. A driving device, comprising:

a signal controller which receives and outputs input image data during a first sub-frame period of one frame period, and which outputs impulsive data having gray-scales, which are lower than those of the input image data, during a second sub-frame period of the one frame period, wherein:

the impulsive data in the frame periods in which still images are displayed comprise first gray-scales, and the impulsive data in the frame periods in which moving images are displayed comprise second gray-scales, the second gray-scale being different from the first gray-scales; and a data driver which converts the input image data to pixel voltages during the first sub-frame period, and converts the impulsive data to impulsive voltages during the second sub-frame period.

* * * * *